United States Patent [19]

Jones

[11] Patent Number: 4,485,628

[45] Date of Patent: Dec. 4, 1984

[54] HIGH TEMPERATURE ENGINE AND SEAL

[76] Inventor: Dedger Jones, 885 Freeway Dr., N., Columbus, Ohio 43229

[21] Appl. No.: 447,267

[22] Filed: Dec. 6, 1982

[51] Int. Cl.[3] ..... F02G 1/053

[52] U.S. Cl. ..... 60/650; 60/682; 92/83; 277/135

[58] Field of Search ..... 60/650, 682, 676; 92/83; 277/135

[56] References Cited

U.S. PATENT DOCUMENTS

| | | | |
|---|---|---|---|
| 13,348 | 7/1855 | Ericsson | 60/650 |
| 1,064,103 | 6/1913 | Smith et al. | 92/83 X |
| 2,157,229 | 5/1939 | Bush | 60/517 X |
| 3,042,390 | 7/1962 | Rausch et al. | 266/21 |
| 3,256,691 | 6/1966 | Dobossy | 60/682 X |
| 3,367,644 | 4/1968 | Ban | 263/28 |
| 3,708,979 | 1/1973 | Bush et al. | 60/682 X |
| 4,120,161 | 10/1978 | Gedeit | 60/682 |
| 4,215,553 | 8/1980 | Poirier et al. | 60/650 |
| 4,254,628 | 3/1981 | Buergel | 60/682 |

*Primary Examiner*—Stephen F. Husar

*Attorney, Agent, or Firm*—John L. Shailer

[57] ABSTRACT

A method and apparatus for protecting a relatively low temperature rated pressure seal from a relatively high temperature gas residing between a cylinder head and its associated piston. A low temperature rated pressure seal as for example an elastomeric seal is protected from high temperature gas in a heat engine, potentially in excess of 2,000° F. (1093° C.) by the use of an intermediary fluid that is trapped in a reservoir in the head of the cylinder said seal being maintained in a liquid fashion by a skirt extension from the head of the piston into the reservoir holding the described liquid, the intermediary liquid also being in contact with the elastomeric seal in the space between the piston and the cylinder. Additionally a heat engine operating at high efficiency utilizing the seal above described in order to maximize efficiency while eliminating leakage and loss of pressure, said heat engine deriving much of its temperature by an economizer that is a counterflow heat exchanger and from external secondary heating sources in constant volume expansion steps.

28 Claims, 2 Drawing Figures

FIG. 1
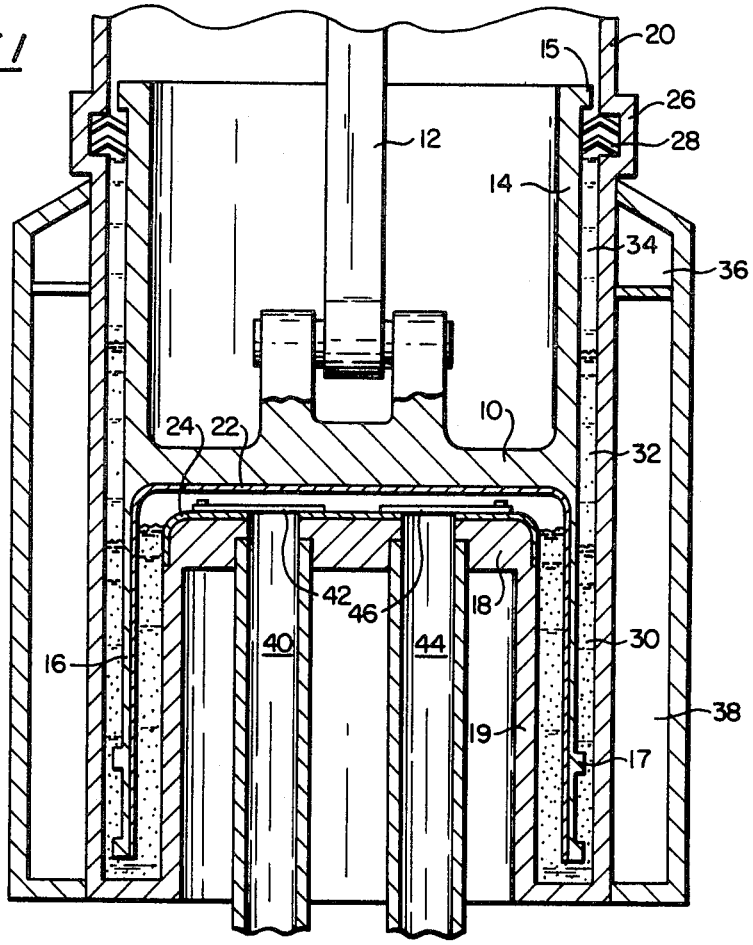
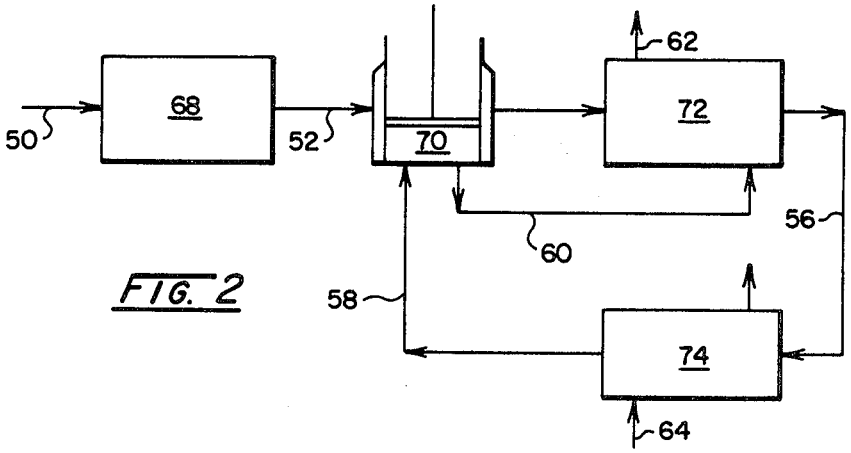
FIG. 2

HIGH TEMPERATURE ENGINE AND SEAL

The invention relates to a method and apparatus for sealing a piston to a cylinder in a piston engine apparatus. The invention more particularly relates to a method of sealing such a piston and cylinder combination using relatively low-temperature rated pressure seals yet operating the cylinder and piston combination at relatively higher temperatures than the rating values of the seals. The invention also relates to a high-temperature heat engine utilizing such a seal and also to a highly efficient heat engine operating at very high temperatures.

The problems of sealing the moving parts of an energy-producing device are well known. Indeed the problems of sealing a piston and cylinder combination have been so severe in the past that the problem has led to the development of alternative devices for extracting energy, these alternative devices then having a different type of sealing apparatus as for example of the centrifugal type or other type to avoid the problems of pressure sealing a sliding motion of a piston within a cylinder. The standard method for sealing a cylinder and piston combination is with oil rings which are discontinuous rings of metal located in the piston wall that slideably engage the interior surface of the cylinder. The quantity and tolerances of construction of these oil rings produces a reasonably leak-tight piston-to-cylinder combination for many general purposes and this device combination is well-known in automobile engines, air compressors and other piston driven apparatus. However, despite the presence of a tortuous or labrynthine type of path, leakage in fact does occur. The problems with this leakage are reduction in power because some of the peak pressure of the driving gas is being bled off past seals and also the introduction of abrasives and pollutants which pass the seals to cause abrasion at the seals and of the cylinder wall and further, to contaminate the oil in the crank case area below the pistons. The production and presence of pollutants and abrasives severely decreases the life of the seals of the cylinder and the piston combination. Additionally the friction of a plurality of oil rings against the cylinder wall reduces power-available.

The problems of pollutants, leakage and abrasives are even more aggravated when higher temperature conditions are attempted within the piston-cylinder combination. Most seals of the elastomeric type have maximum temperature rating in the 500°-600° F. (260°-315° C.) range although some modern seals actually have temperature ratings as high as 900° F. (482° C.). Both of these problems, temperature and pollution abrasion are discussed in U.S. Pat. No. 4,120,161 to Gedeit when he states that he strives to keep the operating temperatures to a maximum of 800° F. (425° C.) and also attempts to segregate combustion gases with the resultant pollutants and abrasives out of the piston cylinder power generating train to protect the pistons and lubricating oils from the carbon deposits, corroding chemical residue and abrasive grit that would be leaking past any seals. In addition to reducing the life of the seals and of the pistons and cylinders there are the maintenance considerations and down-time requirements simply to replace worn or deteriorating seals on a periodic basis. Such a period becoming shorter and shorter as the temperatures increase.

The entire situation is aggravated by the fact that engine efficiency is known to be at its greatest when the engine operating temperatures are at the highest possible levels. The Carnot engine is the theoretical embodiment of the perfect heat engine. The Carnot cycle comprises a four-step cycle beginning with an isothermic expansion followed by an adiabatic expansion, these in turn being followed in order by an isothermic compression and an adiabatic compression. If all of these steps are done in a thermodynamically reversible way the result is a rectangular plot on a temperature-entropy diagram which is known as a standard way of expressing a thermodynamic cycle. Most attempts to produce a more efficient engine have centered upon attempting to approximate a Carnot type of cycle. Carnot efficiency is expressed the difference in the enthalpies represented by the two adiabatic portions of the cycle divided by the enthalpy of the fluid during its adiabatic expansion. In the thermodynamically reversible Carnot cycle this can be further simplified to be the difference in temperature between the working fluid in the engine and the temperature of the heat sink divided by the temperature of the working fluid in the engine. Therefore it can be seen that the greater the temperature difference between the heat sink and the cylinder operating temperature the higher the efficiency of the engine. Heretofore, efficiencies based upon increasing the temperature at which the cylinder operates have been limited by the maximum temperatures not of the metals but of the sealing materials. As the temperature increased the efficiency losses due to loss of compression by leakage past deteriorating or inherently leaking seals was the limiting factor.

SUMMARY OF THE INVENTION

Therefore a primary aspect of the present invention resides in the provision of a relatively low temperature rated seal located in the cylinder wall at a distance away from the cylinder head of at least the maximum piston stoke length.

Another aspect of the present invention lies in the provision of an intermediary fluid between the high temperature working fluid of the cylinder piston area and the seal.

A further aspect of the invention resides in the selection of suitable fluids to serve as the intermediary fluid described above.

Another aspect of the present invention resides in the provision of a heat engine cycle wherein the engine is of the piston-cylinder type sealed with such a sealing apparatus.

A further aspect of the present invention resides in the provision of a very efficient high-temperature engine cycle.

Another aspect of the present invention resides in the provision for manufacturing a cylinder-piston sealed combination relatively inexpensively with a minimum of machining or material surface preparation. Such a construction would inherently be less expensive to manufacture thus bring such high-efficiency technology within the reach of even developing nations at a very reasonable cost.

BRIEF DESCRIPTION OF THE DRAWINGS

FIG. 1 is a cross-sectional elevational view of a piston and cylinder showing a seal structure according to the present invention.

FIG. 2 is a block diagram depicting the cycle for a thermodynamic heat engine according to the present invention.

DETAILED DESCRIPTION OF THE PREFERRED EMBODIMENTS

SEAL

Heretofore the elements for providing a seal between a piston and a cylinder for retaining the pressure that resides in the cavity between the piston head and the cylinder head have been placed in the piston body, as for example "oil rings". The present invention involves a sealing apparatus where the seals are located in the cylinder wall. Such an embodiment is shown in FIG. 1 where piston head 10 is connected to a piston rod or connecting rod 12 and said rod 12 is connected to a fluid cylinder or a crank shaft of some sort for transmission of power. The crankshaft is not shown in FIG. 1. The piston head 10 is shown in close proximity to cylinder head 18 and is shown residing near the cylinder wall 20. The piston has an upper skirt extension 14 which lies in the direction away from the cylinder head and toward the rod end of the piston. This upper skirt assembly 14 is located on the perimeter of the piston 10. Normal pistons with rings also have such a skirt extension in order to provide a place for the oil rings to be located. If oil rings are not present, such a skirt extension would not ordinarily be necessary, however, in the present embodiment upper skirt extension 14 is required since the seals 28 ride against the machined outer surface of upper extension 14.

The piston also has a lower skirt extension 16 which also resides at the perimeter of the piston head 10 and extends downward in a direction into or toward the cylinder head 18. A cavity or reservoir 19 has been formed in the head of the cylinder around the perimeter of the cylinder head 18 sufficient to receive the lower skirt extension 16 and also to retain a sealing fluid 30 which is more fully described below. The reservoir or groove 19 is sufficiently deep to provide clearance at its bottom so that the lower skirt extension 16 does not touch the bottom and the fluids 30 can fully communicate around the end of skirt extension 16. Due to the very high-temperature nature of the engine according to the present invention, insulation 22 is provided on the face of the piston 10 and additional insulation 24 is provided on the cylinder head. This insulation is preferably of the ceramic type capable of sustaining temperatures in excess of 2,000° , thereby protecting the metallic portions of the piston 10 and the cylinder head 18. The insulation 22 on the piston also extends down the inside surface of lower skirt extension 16. A seal preferably of the elastomeric variety with a preferred temperature rating of appoximately 900° F. (482° C.) is retained in a retainer 26 located within cylinder wall 20. The retainer 26 holds the seal material 28 in contact with upper skirt extension 14 providing a tight pressure seal to retain the pressure present between the piston head 10 and the cylinder head 18 within that area preventing it from leaking past.

Fluid 30 discussed above is preferably liquid Gallium or other liquid metal having a liquid range from low temperatures to in excess of cylinder operating temperatures. Gallium has a melting point of 86° F. (29.8° C.) and a boiling point of 3,600° F. (1983° C.) which fully covers the range from ambient or "cold" starting conditions to full temperature operations well in excess of 2,000° F. Other possible metals would be sodium, mercury and tin although sodium has reactivity problems which are well known in the art; mercury may form a bulky emulsion with oils, although this emulsion breaks up upon heating; and tin has a rather high melting point creating problems during start-up. FIG. 1 also shows the presence of a second liquid 32 which floats on top of the liquid Gallium or other liquid metal 30, this liquid 32 is preferably a liquid salt as for example a low temperature drawing salt as manufactured by Park Chemical Co. or equal having a melting point of 275° F. (135° C.) and a maximum working temperature of 1100° F. (593° C.). This salt is a eutectic mixture of nitrate and nitrite salts. This liquid salt is immiscible in the liquid 30 and is also immiscible in liquid 34 which is a high temperature heat transfer oil as for example Dowtherm (a product of Dow Chemical Co.) or other equivalent heat transfer oil that is not miscible in the other two liquids.

Also shown in FIG. 1 is a heat transfer jacket 36 which is an air cooled heat exchanger wrapped around the outside of the cylinder in the area immediately adjacent to the seal 26 area. The purpose of heat transfer jacket 36 is to remove excess heat to maintain the temperature of the heat transfer oil or liquid metal that resides in that zone between the cylinder wall 20 and the upper skirt extension 14 at a temperature belwo the temperature rating of the seal 28. Also shown in a second heat transfer pocket 38 which encircles the cylinder and acts as a preheater for compressed gas that will eventually be fed into the engine 70 more fully described below. Also shown in FIG. 1 are inlet ports 40 with its associated inlet valve 42 and exhaust port 44 with its associated exhaust valve 46.

By closely observing FIG. 1, it will be noted that the only areas requiring detail machining are the area of upper skirt extension 14 which will come in direct contact with seal 28. All other areas are devoid of metal-to-metal contact. Only a moderately finished surface is required for the interior of cylinder wall 20 in order to accommodate the top piston guide 15 and also to accommodate the guide bumps 17 on the exterior surface of lower skirt extension 16. The guides 15 and 17 are solely for the purpose of guiding the piston smoothly in a parallel direction within cylinder wall 20. Liquid metal to solid metal contact does not require a fine-machined surface. A rough finishing surface as in a rough cast surface will be sufficient. Because of the relative thinness of the layer of liquid metal 30 residing between cylinder wall 20 and the exterior surfaces of upper skirt extension 14 and lower skirt extension 16 there is little or no axial mixing. For this reason, there is very moderate amount of heat transfer by other than direct conduction in the liquids 30, 32 and 34. Also the liquid film acts as a lubricant reducing piston to cylinder friction.

It will be appreciated that all three liquids described in FIG. 1 the liquid metal 30, the liquid salt 32 and the oil 34 need not be present in any specific embodiment. The only fluid required may in fact be the liquid metal which is essentially non-volatile, the liquid salt may act alone since it is also non-volatile or any combination of liquids having the above attributes of non-volatility and mutual immiscibility would serve the purposes if the temperature ranges available were appropriate.

HIGH TEMPERATURE HEAT ENGINE

Turning now to FIG. 2 which shows a block diagram of a heat energy cycle according to the present invention. The cycle depicted is an open cycle receiving working fluid, preferably air entering a compressor 68 via line 50, the output of compressor 68 is compressed airline 52 which delivers the compressed working fluid to a heat exchange jacket surrounding the cylinder 70 of the actual engine. The working fluid absorbs more heat from the very hot jacket area of the cylinder and proceeds to economizer 72 via line 54. The thermodynamic process occuring at the cylinder 70 is a constant volume temperature increase which produces a corresponding pressure increase. The economizer 72 is a counterflow heat exchanger with the working fluid entering via line 54 and being heat by a constant volume process in the heat exchanger receiving heat from the exhaust gases coming from the engine 70 via line 60, those gases then exiting the economizer via line 62 returning the working fluid back to the original pressure at which it was received at line 50. The further heated working fluid moves via line 56 to a secondary heat exchanger where heat is input from any other heating process be it from the burning of a conventional fossil fuel or a counterflow heating by a fluid that has been heated in a solar energy cycle. The heating occuring in secondary heat exchanger 74 is again of the constant volume type. Appropriate valves are present in all lines, not shown, toprvent backflow and backpressure; also, appropriate reservoir volumes may be required in order to smooth out the flow. These reservoirs are also not shown. The heated pressurized working fluid then enters the inlet port of the engine via line 58. The inlet port for line 58 was shown on FIG. 1 as item 40 and the exhaust port for line 60 was shown as item 44.

The compressor 68 is primarily an adiabatic pressure process. There is no inter-cooling since obtaining the highest possible temperatures is the purpose of this heat engine process.

In a typical heat engine cycle according to the present invention air at one atmosphere and ambient temperature drawn via line 50 into compressor 68 and pressurized to approximately 60 psig. (4 bar) and its corresponding temperature of approximately 500° F. (260° C.) the temperature of the working fluid is then increased from approximately 500° F. (260° C.) to an excess of 2,000° F. (1093° C.) via the constant volume energy input at engine 70 in the jacket at the economizer 72 and at the secondary heat exchanger 74 yielding a working fluid entering the engine 70 via line 58 with the condition 250 psig (16 bar) and in excess of 2,000° F. (1093° C.).

The expansion in engine 70 is primarily a near-isobaric process pushing the piston in the cylinder to extract energy in a crankshaft or in some other fluid via a piston rod or other appropriate energy extraction/conversion device. Thus, the thermal energy in the cycle is converted to mechanical energy. It will be appreciated that during the expansion cycle under constant pressure conditions in engine 70 that fuel in most any proportion and of any oxidizable type can be injected into the cylinder to create a higher pressure and to produce an additional portion of energy. Any form of fuel can be utilized no matter how dirty such fuel might be since the presence of a sealing mechanism in the engine cylinder wall sealing the piston to the cylinder as described in the previous section of this specification will prevent the leakage of such pollutants or the deleterious effects of any abrasives that may be present in the exhaust or in the fuel itself.

It will also be appreciated that the sealing mechanism described above may also be utilized to pump poisoness gases or materials with pollutants or abrasives in them since the seals will be totally unaffected by the presence of such items. The zero leakage qualities of such a liquid seal will prevent any leakage of poisoness gases and therefore this would be most suitable as a seal for a pump for toxic gaseous materials. Additionally it will be appreciated that if a very close tolerance mirror-like finish machining function is performed on the exterior surface of the upper skirt extension 14 that the useful life of an elastomeric seal will be tremendously increased since there will be no opportunity for it to gall or be abraded by pollutants. Increased life of a seal also produces decreased maintenance and downtime requirements and reduces the cost of maintenance. The greatly reduced machining requirements on this engine being limited primarily to the exterior surface of upper skirt extension 14 make the costs of manufacture of such a system very low indeed.

This invention may be embodied in other specific forms without departing from the spirit or essential characteristics thereof. Present embodiments are therefore considered in all respects as illustrative and not restrictive. The scope of the invention being indicated by the appended claims rather than the foregoing description and drawings and all changes that come within the meaning and range and equivalency of the claims are therefore intended to be embraced therein.

I claim:

1. An apparatus for sealing a cylinder of the type having a closed end and an open end, to a piston of the type having a face end and a rod end, comprising: a first extension skirt located substantially on the perimeter of the face end of said piston extending in a direction parallel to the direction of motion of said piston; a second extension skirt located substantially on the perimeter of the rod end of said piston extending in a direction parallel to the direction of motion of said piston; a reservoir groove located in the closed end of said cylinder, configured to receive said first extension skirt when said piston face and said cylinder closed end are brought into close proximity; a pressure seal retained in the interior-walled surface of said cylinder, contacting the exterior surface of said second extension skirt; a first fluid occupying said reservoir groove and a space defined by the interior surface of said cylinder and the exterior surface of said first and second skirt extensions and further in contact with said pressure seal.

2. An apparatus according to claim 1 wherein said first skirt extension has a length at least equal to the maximum stroke length of said piston.

3. An apparatus according to claim 1 wherein said second skirt extension has a length at least equal to the maximum stroke length of said piston.

4. An apparatus according to claim 1 wherein said pressure seal is located at distance of at least the maximum stroke length of said piston away from the closed end of said cylinder, toward the open end of said cylinder.

5. An apparatus according to claim 1 wherein said first fluid is a liquid.

6. An apparatus according to claim 5 wherein said liquid is a metal.

7. An apparatus according to claim 6 wherein said metal is Gallium.

8. An apparatus according to claim 5 wherein said liquid is a non-volatile salt.

9. An apparatus according to claim 5 wherein said liquid further comprises a second fluid.

10. An apparatus according to claim 9 wherein said second fluid is a liquid.

11. An apparatus according to claim 10 wherein said second and first fluids are immiscible.

12. A method of protecting a relatively low temperature rated pressure seal from a relatively high temperature gas that is being contained, for use in sealing a moving piston to a cylinder in which said piston is located, comprising: extending the perimeter of said piston to form a first skirt extension which extends parallel to the direction of motion of said piston toward the head of said cylinder; extending the perimeter of said piston to form a second skirt extension which extends parallel to the direction of motion of said piston away from the head of said cylinder; inserting said first skirt extension into a reservoir groove in the head of said cylinder, configured to receive said first skirt extension and to retain a first fluid; maintaining a column of said first fluid within said reservoir groove and a space defined by the interior surface of said cylinder, the exteriorsurface of said first and second skirt extensions and said seal; maintaining the temperature of the portion of said first fluid in close proximity to said seal at a temperature less than the rated temperature of said seal.

13. The method according to claim 12 wherein said first skirt extension has a length at least equal to the maximum stroke length of said piston.

14. A method according to claim 12 wherein said second skirt extension has a length at least equal to the maximum stroke length of said piston.

15. A method according to claim 12 wherein said pressure seal is located a distance of at least the maximum stroke length of said piston away from the head of said cylinder.

16. A method according to claim 12 wherein said first fluid is a liquid.

17. A method according to claim 16 wherein said liquid is a metal.

18. A method according to claim 17 wherein said metal is Gallium.

19. A method according to claim 16 wherein said liquid further comprises more than one mutually immiscible liquid.

20. A method of producing mechanical energy through cyclic changes of a gaseous working fluid, compirising in order the steps of: increasing the temperature and pressure of said working fluid by compression; further increasing the pressure of said working fluid by increasing its temperature at a constant volume condition; extracting energy in a near-isobaric expansion in a cylinder driving a piston; exhausting said working fluid from said cylinder, to the initial pressure of said working fluid; wherein said cylinder is of the type having a closed end and an open end, said piston is of the type having a face end and a rod end, and a first extension skirt located substantially on the perimeter of the face end of said piston extends in a direction parallel to the direction of motion of said piston toward the closed end of said cylinder, a second extension skirt located substantially on the perimeter of the rod end of said piston extends in a direction parallel to the direction of motion of said piston away from the closed end of said cylinder, said first skirt extension being inserted in a reservoir groove in the closed end of said cylinder herein said reservoir groove is configured to receive said first skirt extension and to retain a first fluid, said first fluid occupying said reservoir groove and further occupying a space defined by the interior surface of said cylinder and the exterior surface of said first and second skirt extensions, and a pressure-retaining seal located in the wall of said cylinder and in contact with said first fluid.

21. A method according to claim 20 wherein said temperature increase in performed by a counterflow heat exchanger.

22. A method to claim 20 wherein said temperature increase in performed by a counterflow heat exchanger.

23. A method according to claim 21 wherein a portion of said further temperature increase is provided by heat transfer from a secondary heating source.

24. A method according to claim 20 wherein said working fluid is derived from an exterior source to the cycle and is exhausted to said same exterior source in an open cycle.

25. A method according to claim 20 wherein the temperature of said working fluid as it enters said cylinder in said energy extracting step is in excess of 2,000° F.

26. A method according to claim 20 wherein said first skirt extension has a length at least equal to the maximum stroke length of said piston.

27. A method according to claim 20 wherein said second skirt extension has a length at least equal to the maximum stroke length of said piston.

28. A method according to claim 20 wherein said pressure seal is located a distance of at least the maximum stroke length of said piston away from the closed end of said cylinder.

* * * * *

UNITED STATES PATENT AND TRADEMARK OFFICE

CERTIFICATE OF CORRECTION

PATENT NO. : 4,485,628

DATED : December 4, 1984

INVENTOR(S) : Dedger Jones

It is certified that error appears in the above-identified patent and that said Letters Patent is hereby corrected as shown below:

Column 2, line 38, change "stoke" to --stroke--.

Column 4, line 22, change "belwo" to --below--.

Column 4, line 23, change "pocket" to --jacket--.

Column 5, line 23, change "toprvent" to --to prevent--.

In the Claims:

Column 7, line 18; claim 12, line 16, correct "exteriorsur" to --exterior sur- --.

Column 7, line 44; claim 20, line 3, correct "compirising" to --comprising--.

UNITED STATES PATENT AND TRADEMARK OFFICE

CERTIFICATE OF CORRECTION

PATENT NO. : 4,485,628

DATED : Decembet 4, 1984

INVENTOR(S) : Dedger Jones

It is certified that error appears in the above-identified patent and that said Letters Patent is hereby corrected as shown below:

Correct claim 22 to read: Deleting entirely as printed, and replacing with,

22. A Method according to claim 20 wherein a portion of said further temperature increase is provided by heat transfer from a secondary heating source.

Signed and Sealed this

*Fourteenth* Day of *May 1985*

[SEAL]

*Attest:*

DONALD J. QUIGG

*Attesting Officer* *Acting Commissioner of Patents and Trademarks*